United States Patent [19]

Smith

[11] Patent Number: 4,629,095

[45] Date of Patent: Dec. 16, 1986

[54] TOOTHPASTE DISPENSER

[76] Inventor: Allan L. Smith, C/-Hukerenui Post Office, Hukerenui, New Zealand

[21] Appl. No.: 672,363

[22] Filed: Nov. 16, 1984

[30] Foreign Application Priority Data

Nov. 23, 1983 [NZ] New Zealand ..... 206373

[51] Int. Cl.[4] ..... B65D 35/28

[52] U.S. Cl. ..... 222/96; 222/102; 222/105; 141/351; 141/360

[58] Field of Search ..... 222/95–96, 222/101–102, 105, 160, 162; 141/351–352, 360–362

[56] References Cited

U.S. PATENT DOCUMENTS

| | | | |
|---|---|---|---|
| 1,642,797 | 9/1927 | Tracy | 222/102 |
| 1,873,217 | 8/1932 | Reid | 222/102 |
| 2,463,764 | 3/1949 | Grantonic | 222/102 |
| 2,563,733 | 8/1951 | Meczelski | 141/362 X |
| 2,622,768 | 12/1952 | Hatcher | 222/102 |
| 3,233,784 | 2/1966 | Gordon | 222/102 X |

FOREIGN PATENT DOCUMENTS

| | | | |
|---|---|---|---|
| 693126 | 7/1940 | Fed. Rep. of Germany | 222/162 |
| 456872 | 7/1968 | Sweden | 222/96 |

*Primary Examiner*—Charles A. Marmor

*Attorney, Agent, or Firm*—Holman & Stern

[57] ABSTRACT

A toothpaste dispenser incorporates a toothed rack 6, pinion 8 mounted on a carriage having an arm for mounting a toothpaste tube 2, and a closure member 29 to close an outlet 0 of the toothpaste tube pivotally moveable against a bias on insertion of a brush into the apparatus for actuation of the pinion along the rack via a crank lever 33 and a ratchet wheel 17. The tube is driven by the carriage through a pair of squeeze rollers to dispense the toothpaste.

17 Claims, 2 Drawing Figures

TOOTHPASTE DISPENSER

BACKGROUND OF THE INVENTION

1. Field of the Invention

This invention relates to improvements in dispensing means and more particularly to improvements in dispensing means for dispensing fluid or semi-fluid material from tubes.

2. Description of the Prior Art

In the past, there has been a problem in dispensing fluid or semi-fluid material such as pastes, (for example toothpastes) gels, creams and the like from tubes in such a manner that wastage of the fluid or semi-fluid material does not occur.

In the case of toothpaste, there is a tendancy for a significant quantity of toothpaste to be left in the tube when it is discarded often owing to the manner in which the tube is crushed to exude the paste.

There is also a tendancy for the toothpaste to be wasted by some users owing to the way in which certain users use more paste than is required.

Attempts have been made in the past to provide a dispensing arrangement for toothpaste. However, these have been relatively clumsy in construction, have required the use of both hands, which is often inconvenient, and have not in the main resulted in the dispensing of a metered quantity of paste.

Prior dispensing arrangements provided no, or at best, clumsy or inconvenient means for closing off an outlet of the tube in a manner which is simple to operate and is hygienic.

BRIEF SUMMARY OF THE INVENTION

According to one aspect of this invention there is provided a dispenser including a base, mounting means for mounting an evacuable container for fluent material, said container being provided with an outlet for the fluent material, said mounting means being mounted on said base for movement relative thereto, an actuator positioned adjacent said outlet and which, upon being successively actuated by an article on which said material is to be deposited actuates moving means to effect progressive advancement of said container relative to an evacuating means which, upon said advancement of said container, collapses said container to cause said fluent material to be evacuated through said outlet.

Other aspects of this invention, which should be considered in all its novel aspects, will become apparent from the following description. Modifications are envisaged and may be incorporated without departing from the scope of the invention as defined in the appended claims.

BRIEF DESCRIPTION OF THE DRAWINGS

One form of the invention will now be described with reference to the accompanying drawings wherein.

DETAILED DESCRIPTION

With reference to the drawings, the dispenser apparatus as generally indicated by arrow 1 is provided in this form of the invention, for dispensing toothpaste from a toothpaste tube 2 and is preferably formed in a combination of metal and plastics materials although the use of these materials is not essential to the performance of the invention.

Figure 1:
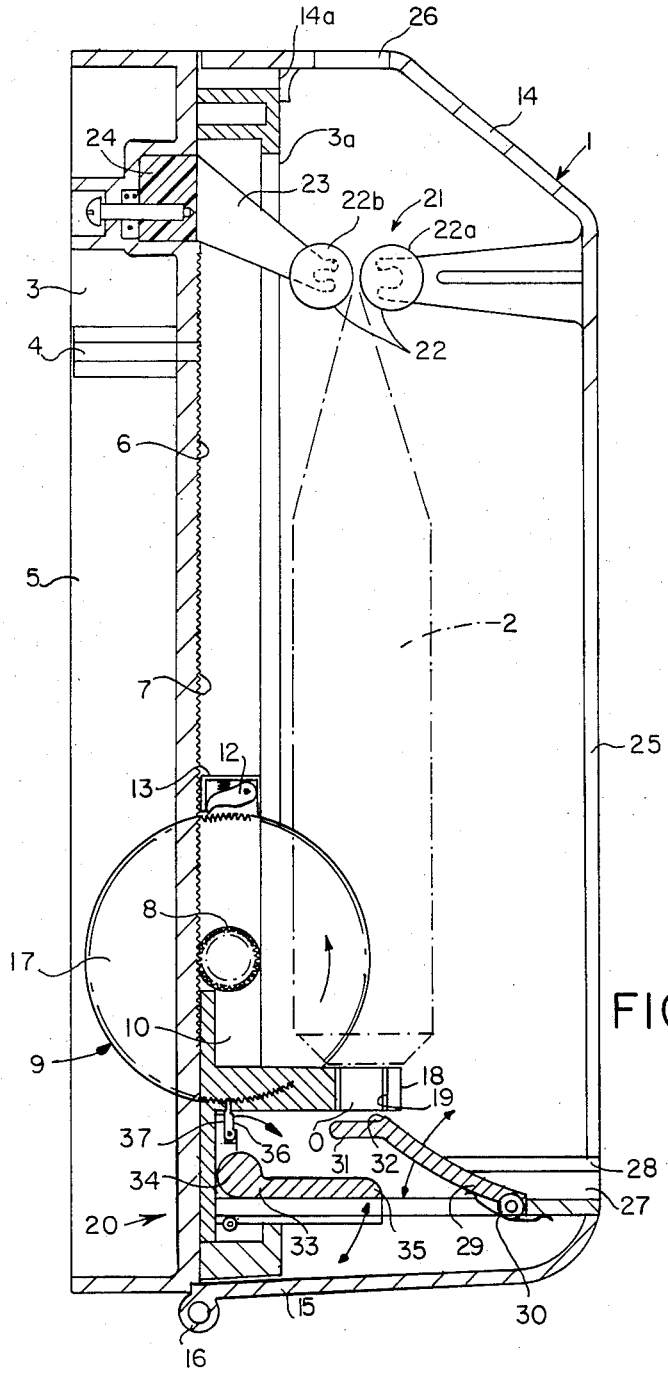
FIG. 1 is a substantially diagrammatic cross sectional side view of a dispenser for tubed toothpaste according to the invention.

Referring now particularly to FIG. 1, the apparatus 1 is preferably adapted for mounting on a wall via a base 3 forming a back 5 of the apparatus 1. The base 3 has apparatus 4 for engaging fixing means to fix the apparatus to a wall or other support.

Figure 2:
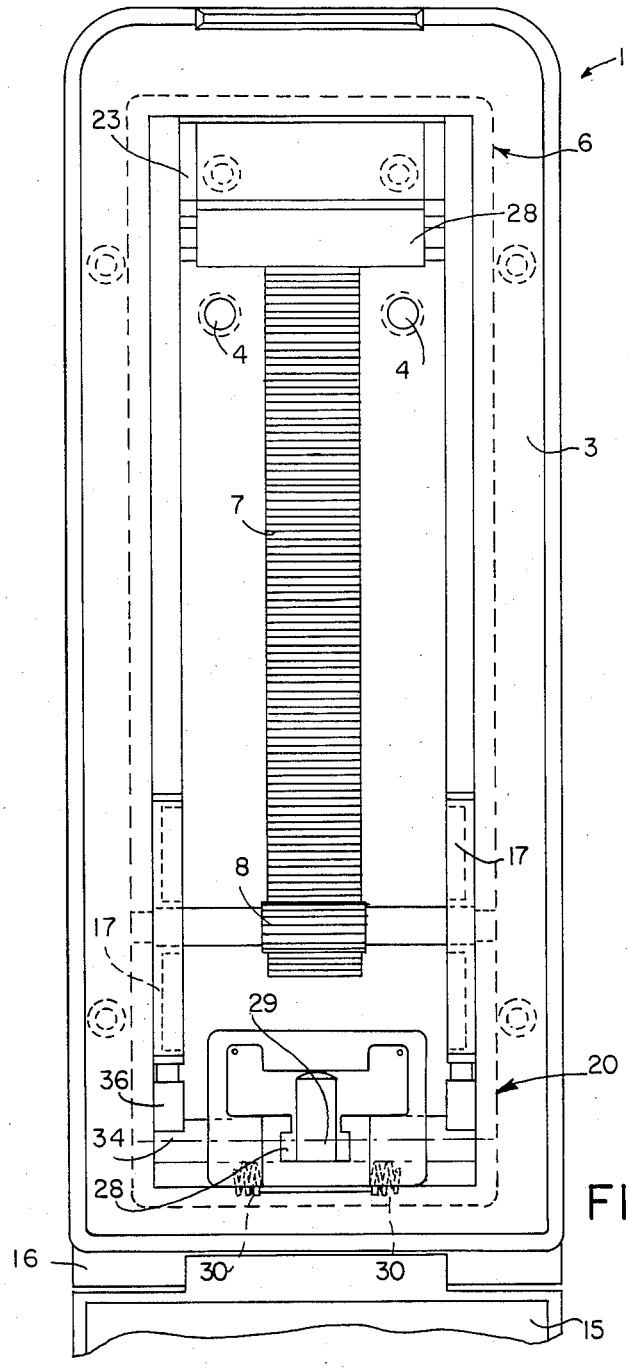
FIG. 2 is a substantially diagrammatic front elevational view of the apparatus of this invention with the container and cover removed to show remaining parts.

Referring to FIGS. 1 and 2, (particularly FIG. 1), a front face 6 of the base 3 provides an elongate generally upright transversely toothed rack 7 with which a roller preferably in the form of a pinion 8 of a moving means as generally indicated by arrow 9 (see FIG. 1) is engaged. The moving means 9 is mounted on a mounting means 10 including a frame which is held via an internally recessed outer base portion 3*a* against the front face 6 of the base 3 so that the pinion 8 is held in engagement with the toothed rack.

The outer base portion 3*a* is secured to the base 3 with a limited degree of free movement therebetween to enable the moving means 9 to disengage and move with the mounting means relative to the base portion 3.

The mounting means 10 is moveable by the moving means 9 substantially upwardly on the base portion 3 upon actuation of the moving means 9 by an actuator described hereinafter. The moving means 9 moves the mounting means 10 relative to the base portion 3 via the interengagement of the pinion 8, or cog, and rack 7. A locking pawl 12 (see FIG. 1) is provided at an upper end of the mounting means 10 and is biasable via biasing means such as a spring 13 to be engageable with drive wheel 17 and prevent a return downward movement of said mounting means 10 unless the outer base portion 3*a* is not held in close association with the front face of the base 3.

The pinion 8 is provided with a pair of co-axially mounted ratchet drive wheels 17 fixed on a common axle to said pinion 8 and to each side of the mounting means frame 10. The ratchet drive wheels 17 are rotatable and are connected with the actuating means 20 described hereinafter.

The limited degree of lost motion between the base 3 and outer base portion 3*a* is provided by mounting the outer base portion 3 on loose fixings and is taken up by the closing of a cover portion 14 on the front face 6 of the base portion 3*a*. The cover portion 14 is hinged at 16 to the base 3 adjacent its base 15 and has a stop portion 14*a* which holds the upper end of the outer base portion 3*a* against the front face 6 and thereby the assembly of the mounting means 10, moving means 9 and non-return pawl 12 in position. The lower end of the outer base portion 3*a* is held by corresponding cover stops (not shown) on the lower inner portions of the cover portion Upon opening of the cover portion 14 on the bottom hinge 16 the outer base portion 3*a* is able to move, to a limited extent, outwardly from the front face 6 to enable disengagement of the pinion 8 relative to the rack 7. This facilitates the mounting means 10 returning downwardly to the lowered position as is shown by FIG. 1 and normally occurs when a fresh container 2 is to be inserted in the apparatus 1.

Opening of the cover portion 14 enables ready access to inside the apparatus 1 and replacement of the container 2 with the mounting means 10. In this preferred form of the invention, the container 2 is mounted on an outwardly extending arm 18 of the frame, said arm 18 having an aperture 19 therein within which the container 2 is screw threadably mounted via its outlet O. In the present form of the invention, the container is of course a toothpaste tube which is normally provided with an outwardly screw threaded outlet O in the form of a nozzle which conveniently screw threads into the aperture 19 which is corresponding internally screw threaded and thus, the container 2 is readily supported on the arm of the mounting means 10.

An upper inner portion of the cover portion 14 also preferably mounts one element of the evacuating means 21 which is provided as a pair of opposingly arranged pinch rollers 22, a first pinch roller 22*a* rotatably mounted to the cover portion 14 and a second roller 22*b* spaced substantially parallelly and transversely relative to a direction of travel of the mounting means 10 from the base portion 3 adjacent the first roller 22*a*. Preferably at least one of the rollers 22 is mounted to be biasable away from the other to a limited extent although not essentially. In the present form of the invention, this is provided by mounting the second roller 22*b* on an offset yolk 23 which in turn is mounted to the base 3 via resiliently deformable block 24. It will be appreciated that deformation of the block enables movement of the roller 22*b* relative to the roller 22*a*.

The cover portion 14 is also provided with a substantially vertically elongate frontal slot 25 therein and an upper opening 26 to enable the container 2, to an extent extend outwardly from the cover portion 14 when the mounting means 10 and therefor, the container 2 is in a raised position relative to the remaining portions of the apparatus 1.

The mounting means 10 is additionally provided with a forwardly directed elongate recess assembly 27 (see particularly FIG. 1) having guide portions extending outwardly therefrom to align substantially with said frontal slot 25, said guide portions defining a recess 28 of an internal size plus a working tolerance for an average range of toothbrushes commonly available. In this preferred form of the invention, the recess 28 terminates inwardly at a butt end thereof adjacent and in this form, beneath the outlet O or nozzle of the toothpaste tube or container 2.

A flap like closure portion 29 is pivotally mounted relative to portions of the recess assembly 27 into and out of closing engagement with the outlet O. The closure is biased, for example by a biasing means such as spring 30 positioned adjacent a butt end of the closure portion 29 so that in a static condition as shown by the solid lines of FIG. 1, the closure portion 29 is resiliently urged upwardly toward a closing position with the outlet O.

In the preferred form of the invention the closure member 29 is preferably provided as a substantially elongate lever like member in substantially flat material and has an outer distal end 31 aligned to close the outlet O.

Preferably, although not essentially, a step 32 is provided adjacent an outlet closing portion, said step being orientated substantially away from the outlet O so that in use, any residue which may remain on the outlet closing portion of the closure 29 is not deposited onto the back of a toothbrush head passed into the recess 28 and depressing the closure portion 29 away from the outlet O against the bias.

The actuating means as generally indicated by arrow 20 is also provided adjacent the outlet O and is connected to the moving means 9. The actuating means 20 incorporates a lever arm 33 pivotable upon a pivot 34 to, in a rest position, position a distal end 35 thereof in the path of the recess 28 to deflect downwardly upon being depressed by the closure portion 29 which is, in turn, pressed downwardly by insertion of the toothbrush in the recess 28.

Biasing means are provided to bias the lever arm 33 into the rest position such as in the form of spring means (not shown) positioned between said lever arm and adjacent portions of the mounting means 10.

A butt end 36 of the lever arm 33 completes the substantially L-shaped nature of the lever arm 33 and mounts a ratchet tooth 37 thereon, outwardly biased, and engaged with teeth of at least one ratchet drive wheel 17.

It will be seen that upon downward deflection of the distal end 35 of the lever arm 33 the engaged ratchet drive wheel 17 is rotated. The moving means 10 is prevented from reverse rotation by engagement of the non-return pawl 12 with the base 3. Thus, the tooth 37 return ratchets under the bias of the lever arm 33 over teeth of the ratchet drive wheel 17 back to the rest position.

It will be appreciated that upon a toothbrush being pushed into the recess 28 said toothbrush deflects the closure portion 29 away from the outlet O, which causes actuation of the actuating means 20 and moving means 9 resulting in upward movement of the mounting means 10 and, via the evacuating means, forcing a predetermined amount of toothpaste from the outlet O onto toothbrush bristles positioned in the recess 28 therebeneath.

It will be appreciated that in such a manner toothpaste can be effectively dispensed from the container 2.

While the invention has been described with reference to a preferred embodiment being a dispenser for toothpaste or other material from a collapsible tube such as a toothpaste tube, it is to be understood that alternative forms of the invention can be provided where alternative constructions of container and remaining apparatus of the invention can be incorporated modified or developed without departing from the scope of the invention as defined in the appended claims.

I claim:

1. A dispenser comprising:

a base;

mounting means for mounting an evacuable container for fluent material, said container having an outlet for said fluent material and said mounting means being mounted on said base for movement relative thereto;

a cog rotatably mounted on said mounting means;

a track on said base in a position to be operatively engaged by said cog in the operating position so that actuation of said cog successively advances said mounting means relative to said base;

evacuating means mounted in the path of movement of said container and engageable therewith to progressively collapse said container to eject fluent material therein through said outlet as said container is advanced with said mounting means; and actuator means on said mounting means positioned adjacent said outlet and operable upon being actuated by an article onto which said fluent material is to be deposited to actuate said cog means;

so that actuation of said actuator means by said article causes an amount of said fluent material to be ejected from said container and deposited onto said article.

2. A dispenser comprising:

a base;

mounting means for mounting an evacuable container for fluent material, said container having an outlet for said fluent material, and said mounting means being mounted on said base for movement relative thereto;

a roller rotatably mounted on said mounting means;

a track on said base in a position to be operatively engaged by said roller in the operating position so that actuation of said roller successively advances said mounting means relative to said base;

evacuating means mounted in the path of movement of said container and engeable therewith to progressively collapse said container to eject fluent material therein through said outlet as said container is advanced with said mounting means; and actuator means on said mounting means positioned adjacent said outlet and operable upon being actuated by an article onto which said fluent material is to be deposited to actuate said roller;

so that actuation of said actuator means by said article causes an amount of said fluent material to be ejected from said container and deposited onto said article.

3. Apparatus as claimed in claim 2 wherein:

said article comprises a toothbrush engageable with said actuator means with a brush head facing said outlet when in an actuating position.

4. Apparatus as claimed in claim 2 and further comprising:

a guiding recess in said mounting means into which said article is insertable and movable into an actuating position in enggement with said actuator.

5. Apparatus as claimed in claim 2 wherein:

said evacuating means comprises at least one roller and an adjacent associated element relatively positioned to receive said container between said at least one roller and adjacent associated element and cooperating to at least partly collapse the container as it advances therebetween.

6. Apparatus as claimed in claim 5 wherein:

said at least one roller of said evacuating means is resiliently mounted to be movable relatively to and resiliently urged toward said adjacent associated element.

7. Apparatus as claimed in claim 2 wherein said moving means further comprises:

at least one ratchet and pawl means mounted on said mounting means and operatively engageable to prevent return movement of said roller and mounting means after each successive advance thereof.

8. Apparatus as claimed in claim 2 wherein said actuator means comprises:

a lever pivotally mounted on said mounting means to be engaged and pivotally moved by said article to actuate said moving means.

9. Apparatus as claimed in claim 4 and further comprising:

a closure for said outlet movably mounted on said mounting means for movement into and out of closing position with said outlet; and biasing means for resiliently urging said closure into the closing position;

said closure being engageable by said article to be moved out of the closing position when said article is in said actuating position.

10. Apparatus as claimed in claim 9 wherein said closure comprises:

a closing face which closes said outlet in the closed position; and a surface adjacent said face slidably engageable by said article;

said face being angularly disposed with respect to said surface for substantially preventing said article from coming into contact with said face.

11. Apparatus as claimed in claim 2 wherein:

said container comprises a toothpaste tube.

12. Apparatus as claimed in claim 3 wherein:

said apparatus comprises a toothpaste tube.

13. Apparatus as claimed in claim 6 and further comprising:

a guiding recess in said mounting means into which said article is insertable and movable into an actuating position in engagement with said actuator means.

14. Apparatus as claimed in claim 13 wherein said moving means further comprises:

at least one ratchet and pawl means mounted on said mounting means and operatively engageable to prevent return movement of said moving and mounting means after each successive advance thereof.

15. Apparatus as claimed in claim 14 wherein said actuator means comprises:

a lever pivotally mounted on said mounting means to be engaged and pivotally moved by said article to actuate said moving means.

16. Apparatus as claimed in claim 14 and further comprising:

a closure for said outlet movably mounted on said mounting means for movement into and out of closing position with said outlet; and biasing means for resiliently urging said closure into the closing position;

said closure being engageable by said article to be moved out of the closing position when said article is in said actuating position.

17. Apparatus as claimed in claim 16 wherein said closure comprises:

a closing face which closes said outlet in the closed position; and a surface adjacent said face slidably engageable by said article;

said face being angularly disposed with respect to said surface for substantially preventing said article from coming into contact with said face.

* * * * *